United States Patent [19]

Ellson et al.

[11] Patent Number: 5,055,987

[45] Date of Patent: Oct. 8, 1991

[54] ADJUSTABLE LIGHT FIXTURE

[75] Inventors: Bart T. Ellson, Chanhassen; Jay J. Kakuk, Plymouth; Robert W. Beachy, Saint Paul, all of Minn.

[73] Assignee: The Toro Company, Minneapolis, Minn.

[21] Appl. No.: 345,053

[22] Filed: Apr. 28, 1989

[51] Int. Cl.[5] ..... F21V 17/02

[52] U.S. Cl. ..... 362/277; 362/145; 362/322; 362/431

[58] Field of Search ..... 362/429, 431, 233, 277, 362/282, 283, 285, 286, 306, 319, 341, 145, 153, 153.1, 341, 346, 319, 322, 433, 187, 280, 281

[56] References Cited

U.S. PATENT DOCUMENTS

| | | | |
|---|---|---|---|
| 1,421,944 | 7/1922 | Humiston . | |
| 1,433,570 | 10/1922 | Stimson . | |
| 1,486,879 | 3/1924 | Graves . | |
| 1,513,211 | 10/1924 | Barany . | |
| 1,751,432 | 3/1930 | Voorhees . | |
| 3,805,055 | 4/1974 | Cassey | 362/431 |
| 4,507,715 | 3/1985 | Wedding . | |
| 4,533,984 | 8/1985 | Gatton | 362/233 |
| 4,768,139 | 8/1988 | Poppenheimer | 362/431 |
| 4,774,648 | 9/1988 | Kakuk et al. | 362/431 |
| 4,807,548 | 9/1989 | Beachy et al. | 362/145 |
| 4,814,961 | 3/1989 | O'Brien et al. | 362/319 |

*Primary Examiner*—Stephen F. Husar
*Assistant Examiner*—D. M. Cox
*Attorney, Agent, or Firm*—R. Lawrence Buckley

[57] ABSTRACT

A light fixture (10) adjustable in focus and/or beam direction. Light fixture (10) is of the "vertical" or "downlighting" type, and preferably includes a bulb/lens assembly (16) mounted atop a relatively short post (14). Bulb/lens assembly (16) includes a lens (30) which rotatably carries a cap (72). Inside lens (30) and beneath cap (72) is a bulb (42) and a reflector assembly (48). Reflector assembly (48) includes a reflector holder (50) having a plurality of outwardly-extending posts (70) which are first received by vertical slots (46) in lens (30) and finally by cam grooves (80) in cap (72). Rotation of cap (72) relative to lens (30) causes cam grooves (80) to act upon posts (70) to move reflector assembly (48) relative to bulb (42). Reflector assembly (48) can be moved vertically relative to bulb (42) to adjust the width or focus of the light beam; and/or tilted vis-a-vis bulb (42) to adjust the direction of the light beam.

10 Claims, 5 Drawing Sheets

ADJUSTABLE LIGHT FIXTURE

FIELD OF THE INVENTION

The invention relates generally to lighting fixtures, and more particularly to lighting fixtures which are adjustable in focus and/or direction.

BACKGROUND OF THE INVENTION

Although the present invention could certainly be applied to indoor light fixtures, for the sake of brevity the following description will focus on the preferred application, outdoor light fixtures. There are many different types of outdoor light fixtures, including those designed to primarily project light upwardly (e.g., "well lights"), those designed to project light laterally (e.g., spotlights and floodlights), and those designed to produce a downwardly directed beam (e.g., "stake" and post lights). The present invention pertains to this last category of lights, i.e. "downlighting" lights. These lights are typically used to illuminate walkways, driveways and relatively low-lying bushes and landscaping details. Their distinguishing characteristic is that they are designed to throw most of their light downward to produce a pattern (typically a circle) of light on a substantially horizontal surface, centered about the post or stake supporting the bulb/lens assembly of the fixture. An example of a stake light is shown in U.S. Pat. No. 4,774,648, assigned to the assignee herein, such lights sometimes being called temple, accent or garden lights. A post light is shown in U.S. Pat. No. 4,507,715.

Stake and post lights and other "downlighting" fixtures have been generally available for some time. Although such fixtures are generally useful for their intended purposes, historically they have not been particularly flexible or adjustable in their application. For example, the typical prior art "stake light" includes a bulb/lens assembly mounted atop a stake having a length of about twelve to eighteen inches. With the stake pushed into the ground, louvers perhaps in combination with a lens produce a circle of light centered about the stake having a diameter of about 6 feet. While this may be adequate for some applications, e.g., general ground lighting of bushes, etc., it is inadequate for other applications, e.g. illuminating a fairly wide path (one which is wider than the radius of the circle of light). A "post light," which typically includes a bulb/lens assembly mounted atop a cylindrical post having a length greater than that of a temple light stake, can indeed create a pattern of light capable of covering the entire width of a path or sidewalk, but post lights are generally more expensive than temples by virtue of their size, and post lights are more obtrusive (i.e., taller) and are less able to produce a more defined spot of light which may be desirable to reduce glare, for example.

Also, Applicants have perceived that there are times when it would be desirable to have the light off-center with respect to the post or stake. For example, it may be desirable aesthetically, and from the standpoint of simple efficiency to dedicate all of the light produced by a fixture to a path rather than allow half of the light to spill out onto the grass as in the case of a "symmetrical" fixture.

While prior "downlighting" fixtures have generally not been particularly flexible in their application, the Assignee herein at least has offered fixtures which are adjustable to a large degree. For example, Toro manufactures an accent or temple light (the subject of U.S. Pat. No. 4,774,648) which includes a middle louver and a cap which can be independently removed to provide additional lateral and uplighting, respectively; and a post light (the subject of U.S. patent application Ser. No. 116,997, filed Dec. 21, 1987) having vertically adjustable louvers which change the aesthetics and the lateral lighting ability of the fixture.

Although the Toro temple and post lights discussed above provide some flexibility and are quite useful for their intended purposes, there is a need for a "vertical" or "downlighting" outdoor fixture which is even more flexible or adjustable, given the wide variety of potential uses for such lights. Therefore, the present invention is directed toward a "vertical" light which is extremely flexible and adjustable to address the problems outlined above.

SUMMARY OF THE INVENTION

Accordingly, the invention includes means for producing a substantially downwardly directed light beam; means for supporting the light beam producing means relative to a substantially horizontal surface, wherein the light beam is projected onto the surface; and optical means operatively disposed relative to the light beam producing means for adjusting the width and/or location of the light beam on the surface.

The "light beam producing means" preferably includes a bulb and a lens, and the "optical means" preferably includes a reflector which can be manipulated with respect to the bulb to adjust the width and/or location of the light beam on the surface.

One method for manipulating the reflector relative to the bulb to adjust the width and/or location of the light beam is to use a "cam means" for selectively moving the reflector up and down relative to the bulb, to adjust the width of the light beam, and for tilting the reflector relative to the bulb to adjust the location of the light beam on the surface. The "cam means" can include a reflector holder in operative contact with the reflector, wherein the reflector holder includes a cam follower; a cap rotatably connected to the lens, wherein the cap forms a cam groove for operatively receiving the cam follower; wherein the lens can form a substantially vertical slot for also receiving the cam follower. The parts are thus arranged and configured such that rotation of the cap relative to the lens causes the cap cam groove to act upon the reflector holder cam follower to move the cam follower in such a way as to adjust the position and/or orientation of the reflector relative to the bulb to adjust the width and/or location of the light beam on the surface. The lens slot limits the cam follower to vertical movement.

In a preferred embodiment, the cap of the light fixture actually forms a plurality of cam grooves suitable for receiving a plurality of "cam followers" which extend from a reflector holder. Also, the lens includes, in that case, a plurality of upwardly-extending elongate members which form vertical slots for also receiving the "cam followers" extending from the reflector holder. The cam grooves in the cap are shaped such that rotation of the cap relative to the lens can result in vertical translation of the reflector relative to the bulb to adjust the focus or width of the light beam and/or tilt the reflector relative to the bulb to adjust the location of the light beam on the fixture's supporting surface.

BRIEF DESCRIPTION OF THE DRAWING

A preferred embodiment of the invention will be described with reference to the appended Drawing, wherein.

DETAILED DESCRIPTION OF PREFERRED EMBODIMENT

Figure 1:
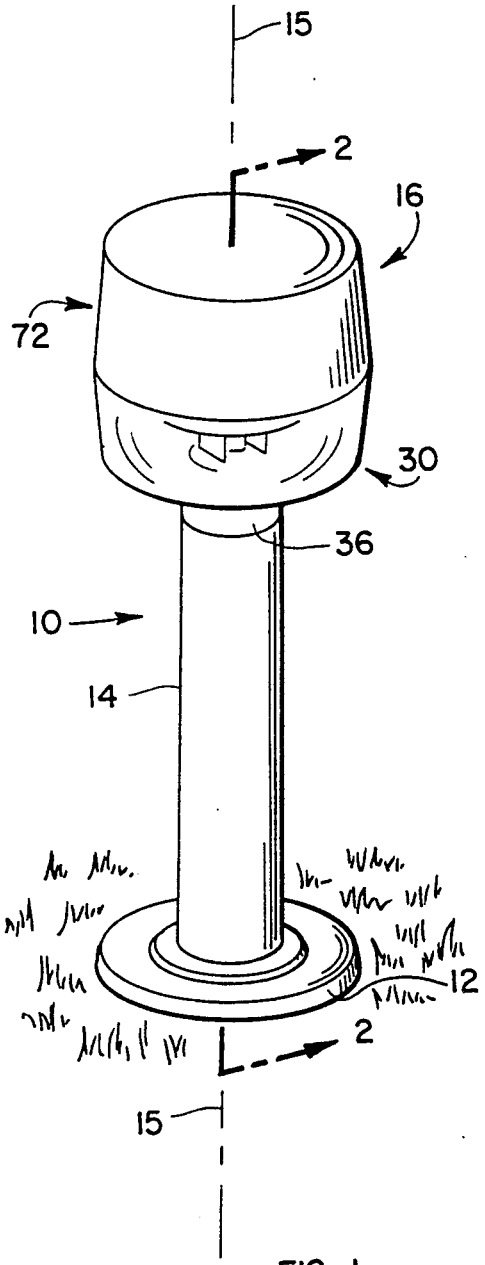
FIG. 1 is a perspective view of a light fixture according to the invention.

With reference to the Drawing, wherein like reference numerals designate like parts and assemblies throughout the several views, FIG. 1 shows a perspective view of a preferred light fixture 10 according to the invention. Light fixture 10 is a type of "downlighting" fixture in the nature of a short post light. As discussed above, a "downlighting" or "vertical" fixture is defined herein as one which is designed to primarily project light downwardly onto a substantially horizontal surface. While various aspects of the present invention can certainly be applied to other types of light fixtures, a "downlighting" fixture such as that shown in the Drawing is indeed the preferred embodiment.

Figure 2:
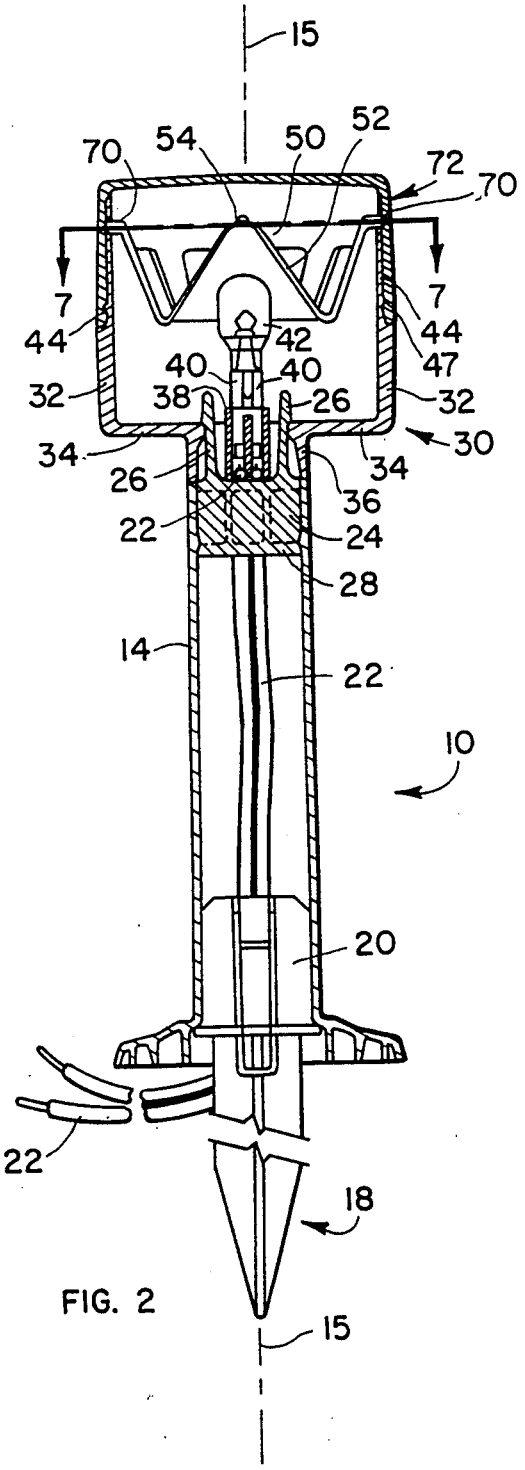
FIG. 2 is a longitudinal sectional view of the light fixture of FIG. 1, taken generally along line 2—2 thereof.

Light fixture 10 preferably includes a circular, horizontal stabilizer plate 12 which normally rests upon the ground or other horizontal supporting surface. Plate 12 can include knockouts which can be drilled or pushed out to accommodate wood screws, in the event fixture 10 is to be mounted to a wooden deck, for example. Extending upward from plate 12 is a post 14 which is hollow to accommodate an electrical cable 22 (see FIG. 2). Of course, fixture 10 could be battery operated, and even perhaps solar charged, in which case an electrical cable would be unnecessary. As show in FIG. 2, post 14 and plate 12 are preferably integrally formed, using injection molding. Extending downward from plate 12 is, for fixtures mounted on the ground, a stake 18 (see FIG. 2). Stake 18 is preferably about eight to twelve inches long and is suitable for insertion into the ground to stabilize fixture 10. As shown in FIG. 2, stake 18 has an upper end 20 which interference fits into the bottom end of post 14, and upper end 20 forms a pair of diametrally-opposed slots which allow electrical cable 22 (shown in FIG. 2) to enter the interior of post 14. Light fixture 10 is fairly elongate, i.e., tall and thin, and is generally circular in cross section and axially symmetrical about longitudinal axis 15.

A bulb/lens assembly 16 is mounted atop post 14. An adapter 24 provides a secure connection between bulb/lens assembly 16 and post 14. Adapter 24 includes a generally cylindrical or at least rounded body 28 which resides within the top end of post 14, either through an interference or some kind of "snap" fit. Extending upwardly from body 28 is a pair of elongate, substantially rectangular ears 26 which are inset slightly from the outer circular periphery of body 28, and which are spaced 180° apart. Ears 26 are preferably about 1 inch long, about 0.625 inch wide and about 0.080 inch thick. They form small notches at their upper ends thereof, the notches in effect facing radially outward, and the upper ends can deflect resiliently inward for purposes discussed below. Body 28 of adapter 24 forms, at its periphery, a pair of longitudinal (i.e., vertical) notches which receive cable 22 so that cable 22 can loop over the top of body 28, and between ears 26 for purposes discussed below.

Bulb/lens assembly 16 includes a transparent or translucent lens 30 having a cylindrical wall 32 which extends upward from a circular bottom wall 34. Extending downward from bottom wall 34, and in the center thereof, is a short downwardly-extending cylindrical portion 36 which forms at its upper end thereof, in effect in horizontal bottom wall 34, a pair of spaced, parallel slits configured to receive the uppermost ends of adapter locking ears 26. With adapter 24 inserted into the top end of post 14, lens 30 can be snapped onto adapter 24 as shown in FIG. 2, wherein the small notches in ears 26 rest on the top surface of lens bottom wall 34 and prevent removal of lens 30 unless ears 26 are pinched inwardly toward one another.

At the center of lens bottom wall 34 and extending downwardly therefrom is a bifurcated apertured structure 38 which accommodates a pair of elongate metal contacts 40 which serve two purposes they make piercing electrical contact with electrical cable 22 at their bottom ends and support and make electrical contact with a bulb 42 at their top ends. Contacts 40 and their supporting structure 38 are disclosed in U.S. Pat. No. 4,774,648, incorporated herein by reference. Thus, bulb 42 is axially fixed relative to lens 30, a point which is important for reasons set forth below. Also, lens 30 is, for the most part, rotationally and axially constrained with respect to post 14.

Figure 3:
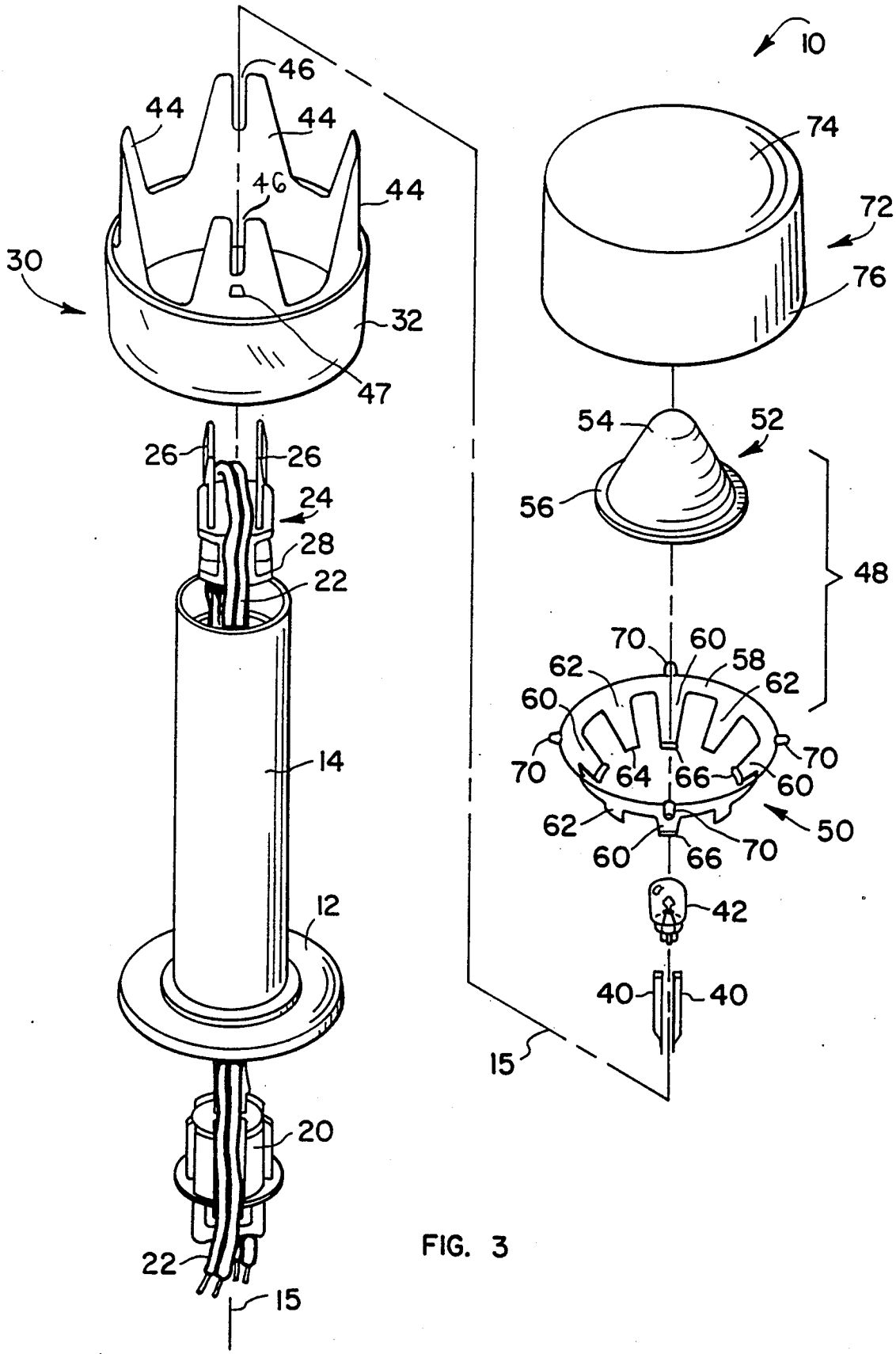
FIG. 3 is an exploded view of the light fixture of FIG. 1.

Extending upwardly from vertical wall 32 of lens 30 are four identical elongate elements 44, spaced 90 degrees apart (see FIG. 3). Each element 44 forms a vertical slot 46 at its mid-line, extending along the upper half of the element and opening at the top thereof.

Extending outwardly from each elongate member 44, immediately below the corresponding slot 46, is a small bump 47, the purpose of which is described below.

Elongate elements 44 of lens 30 are designed to receive a reflector assembly 48 which includes a reflector holder 50 and a reflector 52. Reflector 52 is preferably made of stamped metal, e.g. aluminum, and is substantially conical in shape. A rounded apex 54 of reflector 52 is pointed toward the top of fixture 10. Reflector 52 includes a circular rim 56 at its lower extremity, rim 56 extending radially outwardly therefrom. The width of rim 56 is preferably about 0.060 inch and the included angle of reflector 52 is preferably about 50 degrees. Other included angles are possible, depending on the desired lighting characteristics of the fixture, i.e. whether the fixture is to produce a fairly concentrated beam or a fairly diffuse beam.

Reflector holder 50 is frusto-conical in overall shape. It has a circular ring or band 58 at the top thereof and extending downward and inward from band 58 are four evenly-spaced "long" fingers 60 and four evenly-spaced "short" fingers 62, wherein long fingers 60 are spaced 90 degrees apart from one another and short fingers 62 are spaced in like manner and the short and long fingers regularly alternate around the inner and lower periphery of band 58. Each short finger 62 terminates at its lower tip with a horizontal surface 64 which is parallel to the top surface of band 58. Long fingers 60, on the other hand, each terminate with a short inwardly directed lip 66. The lower diameter of reflector holder 50 is substantially equal to the lower, and larger, diameter of reflector 52. The lower tips 64 of short fingers 62 bear downwardly on the upper surface of reflector rim 56, whereas lips 66 of long fingers 60 bear upwardly on the lower surface of reflector rim 56. Therefore, reflector 52 is axially fixed to reflector holder 50. The outer diameter of reflector holder 50 is preferably about 3 inches, the inner or lower diameter is about 2 inches, and the included angle of reflector holder 50 is about 80 degrees. Long fingers 60, in particular, keep reflector 52 centered and in position by pressing radially inwardly on the outer periphery of rim 56 at four places, spaced 90 degrees apart. The natural radial springiness of long fingers 60 holds reflector 52 securely in place and centered on the longitudinal center line 15 of fixture 10.

Extending radially outwardly from the upper rim of reflector holder band 58 are four equally-spaced (on 90 degree intervals) short cylindrical posts 70, the axis of each post 70 being colinear with a line extending radially out of the center of reflector holder 50. Posts 70 are sized to slidably fit within vertical slots 46 in elongate elements 44. Posts 70 actually extend slightly beyond the outer convex periphery of elongate elements 44 for purposes which will be discussed below. Also. the upper, larger diameter of band 58 is slightly less than the inner diameter of lens 30 so that reflector holder 50 can freely translate vertically and tilt within the confines of lens 30. When reflector 52 and its holder 50 are assembled, apex 54 of reflector 52 is roughly coplanar with posts 70 extending outwardly from band 58 of reflector holder 50.

Figure 5:
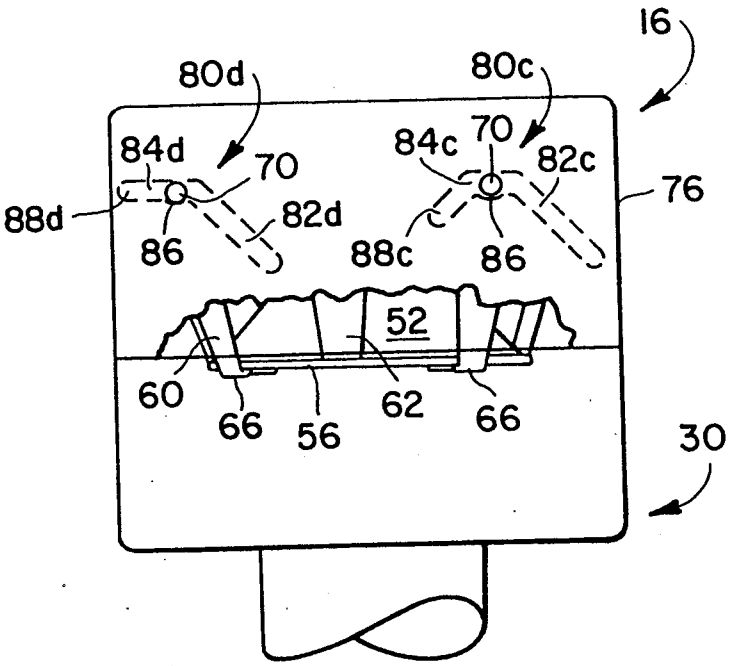
FIG. 5 is an enlarged elevational view of the first side of the bulb/lens assembly of the light fixture illustrated in FIG. 1, showing the reflector assembly in its uppermost straight position.
Figure 4:
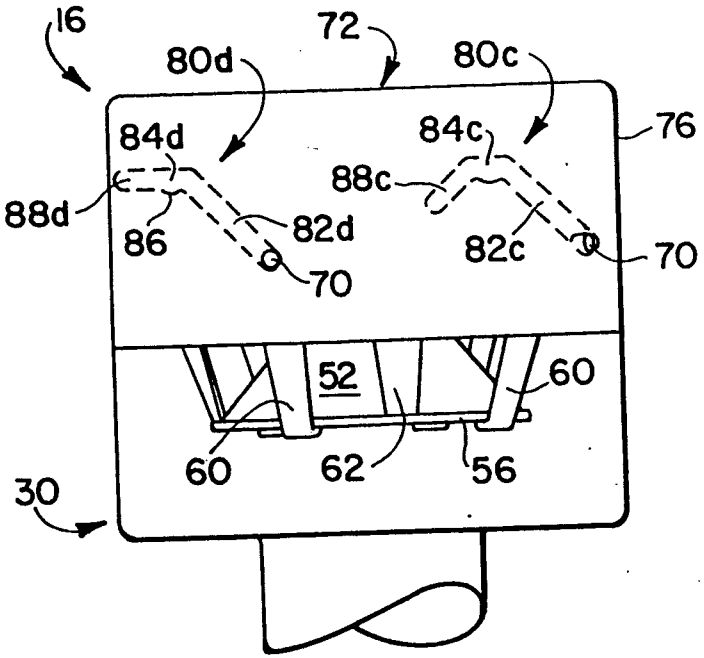
FIG. 4 is an enlarged elevational view of a first side of the bulb/lens assembly of the light fixture illustrated in FIG. 1, showing the reflector assembly thereof in its lowermost position.
Figure 6A:
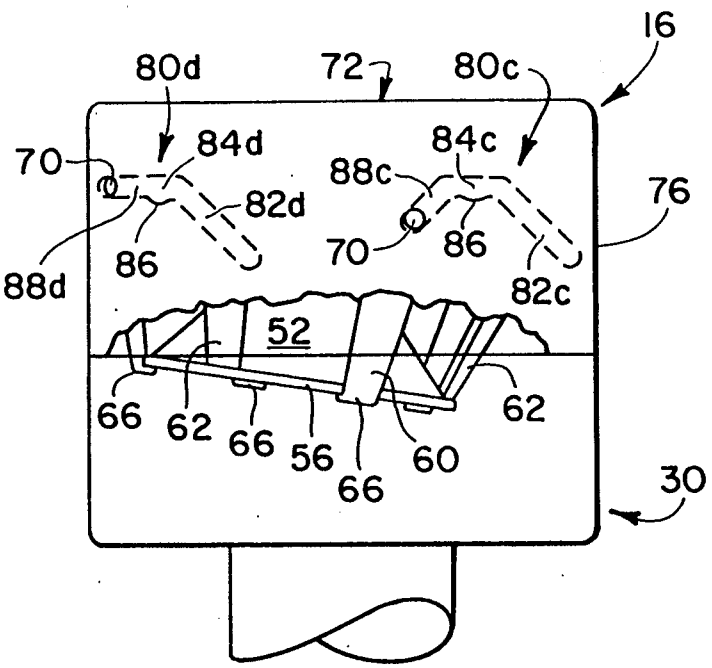
FIG. 6A is an enlarged elevational view of the first side of the bulb/lens assembly of the light fixture illustrated in FIG. 1, showing the reflector assembly in its tilted position.
Figure 6B:
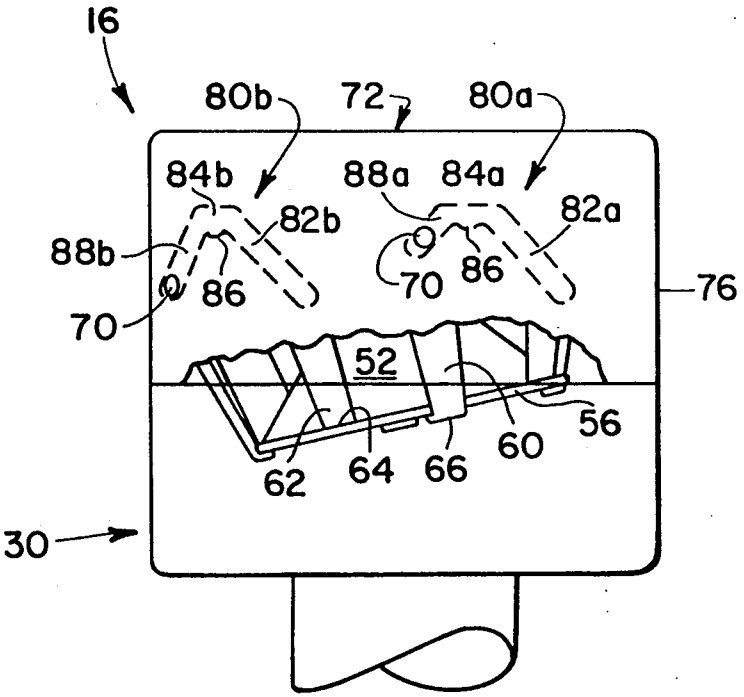
FIG. 6B is an enlarged elevational view of a second side of the bulb/lens assembly of the light fixture of FIG. 1, opposite the first side thereof, showing the reflector assembly in its tilted position.

At the very top of fixture 10 is a cap 72 which includes a circular top wall 74 and a cylindrical side wall 76. Top wall 74 can include apertures for heat venting purposes, but proper selection of the material of cap 72 can remove the necessity for vents. Referring in particular to FIGS. 4, 5 and 6, side wall 76 forms unique cam grooves 80 in its inner surface thereof to slidably receive posts 70 extending from reflector holder 50. Grooves 80, which preferably do not extend completely through the vertical wall 76 of cap 72, are nominally spaced 90 degrees apart. Grooves **80*a* and 80*c* are diametrally-opposed to one another, and grooves 80*b* and 80*d* are also diametrally opposed. There are actually three different types of grooves 80, as shown in FIGS. 4, 5, and 6. Opposed grooves 80*a* and 80*c* are substantially identical. Opposed grooves 80*b* and 80*d* are unique as compared to each other and unique as compared to grooves 80*a* and 80*c***, as further explained below.

In addition to cam grooves 80, cap side wall 76 also forms one or more horizontal (i.e., parallel to cap top surface 74) retention grooves (shown sectionally in FIG. 2) which are located below the cam grooves and which simply receive bumps 47 extending outwardly from elongate members 44. Thus, cap 72 snap fits onto lens 30 and no fasteners are needed. Bumps 47 can freely slide within the retention grooves to allow twisting of cap 72 relative to lens 30.

Each groove 80 includes a fairly long "focusing" ramp 82 at the right end thereof (looking radially inward from outside the fixture, the perspective of FIGS. 4, 5, and 6). Each focusing ramp 82 forms an angle of roughly 40 degrees with the horizontal. Also, focusing ramps 82 are substantially straight from the perspective of FIGS. 4–6, but of course they follow the curved contour of cap side wall 76 when viewed from above.

Each groove 80 can also have a short transition zone 84 at the upper end of the corresponding focusing ramp. Each transition zone 84 is, on the whole, substantially horizontal and preferably includes a small "dip" or trough 86, for purposes discussed below. Each groove 80 also includes, on its left end (as shown in the Drawing), a "tilting ramp" 88. While grooves **80*a* and 80*c* have substantially identical tilting ramps 88, the tilting ramps 88 for grooves 80*b* and 80*d* are quite different from one another and from those of grooves 80*a* and 80*c*. Grooves 80*a* and 80*c* have tilting ramps 88*a* and 88*c*, respectively, which angle downward from the horizontal at about 35 degrees and are only about half the length of the corresponding focusing ramps 82. By contrast, tilting ramp 88*b* of groove 80*b*, Which angles downward at about 55 degrees from the horizontal, is about the same length as the focusing ramps 82; and tilting ramp 88*d* of groove 80*d* is fairly short and substantially horizontal, thereby being merely an extension of the transition zone 84*d* of groove 80*d***.

Figure 7:
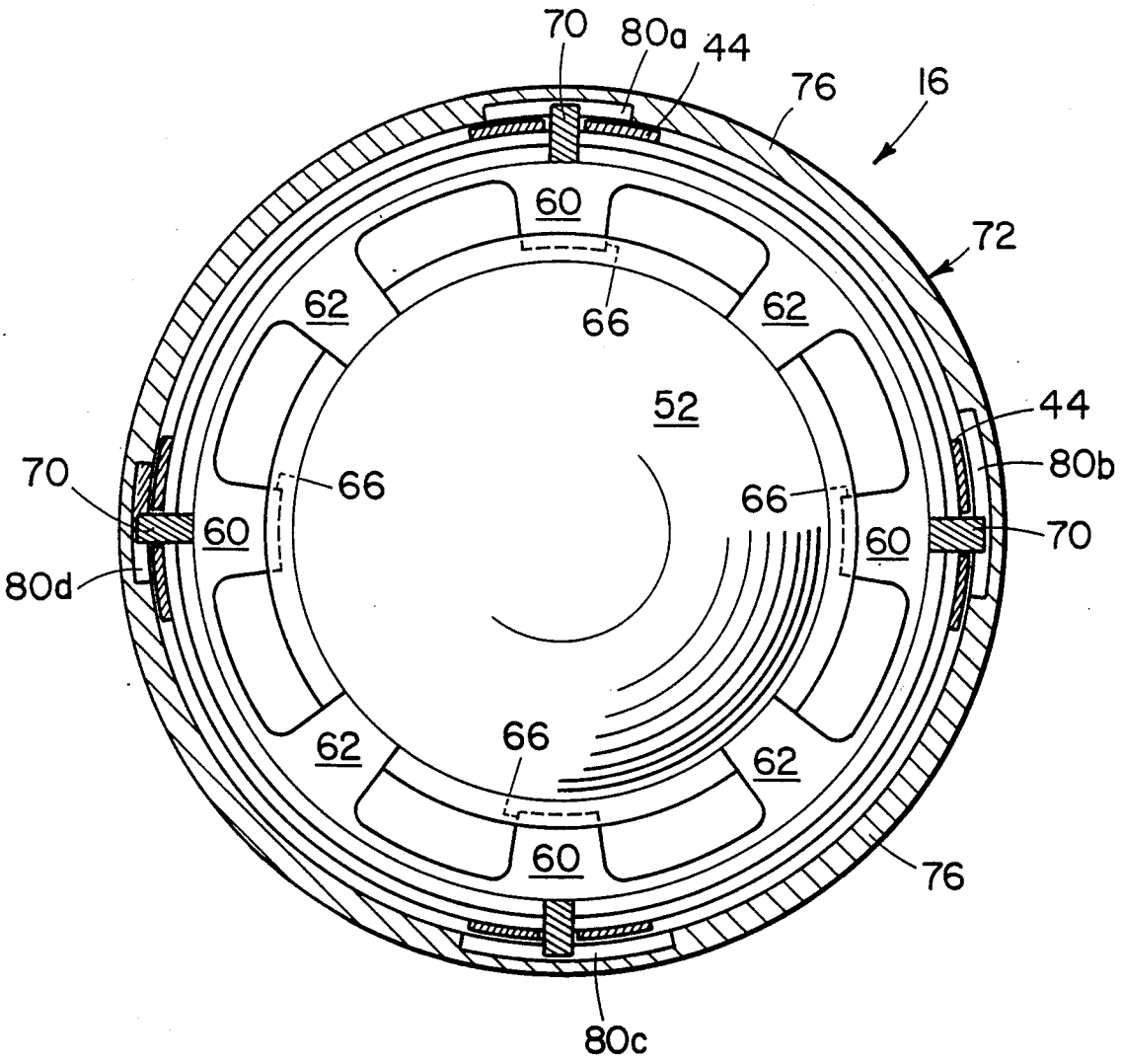
FIG. 7 is a transverse sectional view of the light fixture shown in FIG. 1, taken generally along line 7—7 of FIG. 2.

FIG. 7 is a transverse sectional view of fixture 10 showing how posts 70 of reflector holder 50 are received by slots 46 in elongate members 44 and by cam grooves 80 in cap 72. When the cap 72 is rotated relative to the lens, grooves 80 in cap 72 cause posts 70 of reflector holder 50 to translate vertically within slots 46. Posts 70 of reflector assembly 48 move directly vertically because they are constrained within slots 46 of stationary lens 30. As cap 72 is rotated counterclockwise over its first 31 degrees of travel, posts 70 are forced upward in concert by focusing ramps 82 so that the plane which contains posts 70 remains substantially horizontal and so that the only effect is a change in the diameter of the light pattern created on the horizontal supporting surface. That is, the light pattern created during the focusing phase is still substantially centered on longitudinal axis 15 of the fixture. With reflector 52 in its lowermost position (as shown in FIG. 4), a two-foot diameter circle of light is created on the "ground," whereas with the reflector 52 in its uppermost position (see FIG. 5) a 16-foot diameter circle of light is created, again centered about longitudinal axis 15 of fixture 10.

When cap 72 has been sufficiently rotated in the counterclockwise direction, and posts 70 have been forced to the tops of the focusing ramps 82. Posts 70 in effect drop into the small dips or troughs 86 created in the transition zones 84 of cam grooves 80 so that light fixture 10 can readily remain in the "maximum focus" state despite occasional vibration of the fixture due to wind, for example. The transition zones 84 of grooves 80 occupy about 5 degrees of cap travel, so reflector assembly 48 "dwells" in its uppermost or "maximum focus" state for a time. With continued CCW rotation of cap 72, posts 70 are individually manipulated by the tilting portions 88 of grooves 80 to cause tilting of reflector assembly 48 shown in FIGS. 6A and 6B, these Figures showing fixture 10 in its "tilted" state from opposite sides. Specifically, when cap 72 has been rotated as far as possible in the CCW direction (preferably about another 23 degrees after the dwell period defined by transition zones 84) post 70 captured within groove 80*b* is pushed vertically downward about ½ inch from its fully raised position; posts 70 captured within grooves 80*a* and 80*c* move downward about ¼ inch from their uppermost positions; and post 70 within groove 80*d* remains in its uppermost position, by virtue of the fact that tilting portion 88*d* of groove 80*d* is merely a horizontal extension of its corresponding transition portion 84*d*. This results in reflector assembly 48 tilting about 9 degrees from the horizontal. It should be noted that apex 54 of reflector 52 remains substantially on fixture longitudinal axis 15 throughout the focusing and tilting procedures.

It should be noted that there could be some type of locking means to hold the reflector holder 50 in a preselected position along the focusing ramps 82. Although, the embodiment shown in the Drawing primarily depends on friction between posts 70 and the mating cam grooves 80, other schemes could obviously be used to hold fixture 10 in a preselected focusing or tilting state. For example, the retention groove(s) (shown sectionally in FIG. 2) in cap 72 could include small "steps" or "bumps" which would periodically interfere with the travel of bumps 47 within the retention groove(s) to cause the rotation of cap 72 to occur in small increments, accompanied by a clicking noise or sensation.

It should also be noted that the finger-like construction of reflector holder 50 and the uppermost portion of lens 30 permits their snap-fit assembly with reflector 52 and cap 72, respectively.

There are other modifications which will be apparent to those skilled in the art. Accordingly the scope of this invention will be limited only by the appended claims.

We claim:

1. A downlighting light fixture comprising:

(a) means for producing a substantially downwardly directed light beam;

(b) means for supporting the light beam producing means relative to a substantially horizontal surface, wherein the light beam is projected onto the surface; and (c) optical means operatively disposed relative to the light beam producing means for adjusting the location of the light beam on the surface, wherein relative movement between the optical means and the light beam producing means effects the adjustment of the location of the light beam on the horizontal surface, wherein the light beam producing means comprises a bulb/lens assembly operatively connected to the supporting means, the bulb/lens assembly comprising a bulb enclosed at least partially by a lens, wherein the optical means comprises a reflector and means for manipulating the reflector to change its orientation relative to the bulb to adjust the location of the light beam, and wherein the location of the light beam can be adjusted without moving the light beam producing means relative to the supporting means.

2. A downlighting light fixture comprising:

(a) means for producing a substantially downwardly directed light beam;

(b) means for supporting the light beam producing means relative to a substantially horizontal surface, wherein the light beam is projected onto the surface; and (c) optical means operatively disposed relative to the light beam producing means for adjusting the width and the location of the light beam on the surface, wherein relative movement between the optical means and the light beam producing means effects the adjustment of the width and the location of the light beam on the horizontal surface, wherein the light beam producing means comprises a bulb/lens assembly operatively connected to the supporting means, the bulb/lens assembly comprising a bulb enclosed at least partially by a lens, wherein the optical means comprises a reflector and means for manipulating the reflector to change its position and orientation relative to the bulb to adjust the width and location, respectively, of the light beam, and wherein the width and location of the light beam can e adjusted without moving the light beam producing means relative to the supporting means.

3. The light fixture of claim 2, wherein the reflector manipulating means comprises cam means for selectively moving the reflector up and down relative to the bulb, to adjust the width of the light beam on the surface, and for tilting the reflector relative to the bulb to adjust the location of the light beam on the surface.

4. The light fixture of claim 3, wherein the cam means comprises:

(a) a reflector holder in operative contact with the reflector, the reflector holder comprising a cam follower;

(b) a cap rotatably connected to the lens, wherein the lens comprises a member covered by and adjacent the cap, and wherein the cap forms a cam groove for operatively receiving the cam follower; and (c) a substantially vertical slot formed by the lens member, wherein:

(i) the cam follower extends through the lens slot into the cap cam groove, thereby rotationally fixing the reflector to the lens; and (ii) rotation of the cap relative to the lens causes the cap cam groove to act upon the reflector holder cam follower to move the cam follower vertically, as constrained by the vertical lens slot, to selectively adjust the width and direction of the light beam on the substantially horizontal surface.

5. The light fixture of claim 3, wherein the cam means comprises:

(a) a reflector holder in operative contact with the reflector, the reflector holder comprising a plurality of cam followers;

(b) a cap rotatably connected to the lens, wherein the lens comprises a plurality of upwardly-extending elongate members covered by and adjacent the cap, and wherein the cap forms a plurality of cam grooves for operatively receiving the cam followers; and (c) a substantially vertical slot formed by each lens member, wherein:

(i) each cam follower extends through the corresponding lens slot into the corresponding cap cam groove, thereby rotationally fixing the reflector to the lens; and (ii) rotation of the cap relative to the lens causes the cap cam grooves to act upon the corresponding reflector holder cam follower to move the cam follower vertically, as constrained by the corresponding vertical lens slot, to selectively adjust the width and direction of the light beam on the substantially horizontal surface.

6. The light fixture of claim 5, wherein:

(a) the cam grooves are substantially horizontally aligned and each groove comprises an inclined focusing ramp, a transition zone located at the top of the corresponding focusing ramp, and a tilting ramp adjacent the corresponding transition zone; wherein the focusing ramps are substantially identical to one another, and the transition zones are substantially identical to one another, but wherein the tilting ramps are not all identical to one another:

(b) rotation of the cap in a first direction relative to the lens causes the cam followers, vertically constrained by the lens slots, to travel in concert up the focusing ramps, thereby horizontally raising the reflector holder and reflector relative to the bulb to increase the width of the light beam on the horizontal surface;

(c) continued rotation of the cap in the first direction causes the cam followers to dwell for a time in their respective transition zones; and (d) further rotation of the cap in the first direction causes the cam followers to traverse their respective tilting ramps, thereby tilting the reflector holder and reflector to adjust the direction of the light beam on the horizontal surface.

7. The light fixture of claim 6, wherein there are first, second, third, and fourth cam followers substantially equally spaced about the periphery of the reflector holder, and corresponding first, second, third, and fourth slotted elongate lens members and cam grooves, wherein:

(a) the first and third diametrally-opposed cam grooves are substantially identical in all respects, each having a tilting ramp which angles downward at a first angle from the corresponding transition zone;

(b) the second cam groove has a substantially horizontal tilting ramp; and (c) the fourth cam groove has a tilting ramp which angles downward at a second angle, greater than the first angle, from the corresponding transition zone, whereby when the cap is rotated relative to the lens in the first direction to cause the cam followers to enter their respective tilting ramps the reflector is tilted because the second cam follower remains substantially motionless, the first and third cam followers move downward in concert a first distance as determined by the first angle, and the fourth cam follower moves downward a second distance, greater than the first distance, as determined by the second angle.

8. A light fixture comprising:

(a) means for producing a substantially downwardly directed light beam comprising:

(i) a bulb;

(ii) a lens located beneath and operatively supporting the bulb;

(iii) a cap located above the bulb and in operative contact with the lens; and (iv) a reflector located between the cap and bulb and in operative contact with the cap; and (b) means for supporting the light beam producing means relative to a substantially horizontal surface, wherein the light beam is projected onto the surface; the supporting means comprises a post operatively connected to and supporting the lens; and rotation of the cap relative to the lens causes relative movement between the reflector and the bulb to effect adjustment of the width of the light beam on the horizontal surface.

9. The light fixture of claim 8, wherein rotation of the cap relative to the lens further effects adjustment of the location of the light beam on the horizontal surface.

10. A light fixture comprising:

(a) means for producing a substantially downwardly directed light beam comprising:

(i) a bulb;

(ii) a lens located beneath and operatively supporting the bulb;

(iii) a cap located above the bulb and in operative contact with the lens; and (iv) a reflector located between the cap and bulb and in operative contact with the cap; and (b) means for supporting the light beam producing means relative to a substantially horizontal surface, wherein the light beam is projected onto the surface; the supporting means comprises a post operatively connected to and supporting the lens; and rotation of the cap relative to the lens changes the orientation of the reflector relative to the bulb to adjust the location of the light beam on the horizontal surface.

* * * * *